US005224345A

United States Patent [19]

Schnaibel et al.

[11] Patent Number: 5,224,345

[45] Date of Patent: Jul. 6, 1993

[54] METHOD AND ARRANGEMENT FOR LAMBDA CONTROL

[75] Inventors: Eberhard Schnaibel, Hemmingen; Lothar Raff, Hochberg; Günther Plapp, Filderstadt; Cornelius Peter, Ottersweiher; Michael Westerdorf, Möglingen, all of Fed. Rep. of Germany

[73] Assignee: Robert Bosch GmbH, Stuttgart, Fed. Rep. of Germany

[21] Appl. No.: 679,050

[22] PCT Filed: Mar. 17, 1989

[86] PCT No.: PCT/DE89/00164

§ 371 Date: May 9, 1991

§ 102(e) Date: May 9, 1991

[87] PCT Pub. No.: WO90/05240

PCT Pub. Date: May 17, 1990

[30] Foreign Application Priority Data

Nov. 9, 1988 [DE] Fed. Rep. of Germany ..... 3837984

[51] Int. Cl.[5] ..... F01N 3/20

[52] U.S. Cl. ..... 60/274; 60/276; 60/285; 123/674; 123/691

[58] Field of Search ..... 60/274, 276, 285; 123/674, 691

[56] References Cited

U.S. PATENT DOCUMENTS

| | | | |
|---|---|---|---|
| 3,939,654 | 2/1976 | Creps | 60/276 |
| 4,235,204 | 11/1980 | Rice | 60/276 |
| 4,901,240 | 2/1990 | Schmidt | 123/440 |
| 5,117,631 | 6/1992 | Moser | 123/674 |

*Primary Examiner*—Douglas Hart
*Attorney, Agent, or Firm*—Walter Ottesen

[57] ABSTRACT

An arrangement for lambda control operates on an internal combustion engine (11) comprising a catalytic converter (12) and a lambda probe (**13.*v*) mounted in front of the catalytic converter and a lambda probe (13.*h*) mounted behind the catalytic converter. The arrangement integrates by means of an integration means (15) the difference between the actual lambda value measured by the rear probe and the lambda desired value to which controlling is to be effected. The integration value is used as control desired value for a means (16**) for lambda control. This arrangement and the associated method make it possible to control to the actually wanted lambda desired value even if the front lambda probe carries out incorrect measurements, for example because of hydrocarbons in the exhaust gas in front of the catalytic converter or, in the case of continuous-action control, faulty linearization of the probe characteristic.

3 Claims, 2 Drawing Sheets

METHOD AND ARRANGEMENT FOR LAMBDA CONTROL

FIELD OF THE INVENTION

The invention relates to a method and an arrangement for controlling the air/fuel mixture to be supplied to an internal combustion engine with the aid of the actual lambda value measured by a lambda probe arranged in front of a catalytic converter. The invention also relates to an arrangement for carrying out such a method.

BACKGROUND OF THE INVENTION

It is known from internal combustion engines with catalytic converter to arrange one lambda probe each in front of and behind the catalytic converter. The front one measures an actual lambda value front and the rear one an actual lambda value rear. The actual lambda value front is subtracted from the lambda control desired value to which controlling is to be effected. The system deviation formed in this manner is converted by a means for lambda control into a manipulated variable which is dimensioned such that the system deviation is to be eliminated by the manipulated variable. The actual lambda value rear is used for monitoring the catalytic converter activity.

It is known that the actual lambda value rear fluctuates less than the actual lambda value front and that it provides more accurate information on the actual lambda value. This is because the lambda value measured by a lambda probe depends not only on the oxygen content of the measured mixture but also on the content of unburnt hydrocarbons. In the catalytic converter, a residual combustion and an equalization of fluctuations occur, as a result of which the rear lambda probe can very accurately determine the actual lambda value of the air/fuel mixture supplied to the internal combustion engine.

Because of the high accuracy of the actual lambda value rear, it is desirable to form the system deviation with the aid of this actual value. However, this cannot lead to practical results because a very large dead time passes between the preparation of an air/fuel volume and the time at which this volume reaches the rear lambda probe, now as burnt mixture. This makes it impossible to provide meaningful control. However, it would be possible to correct a manipulated variable formed by a means for lambda control with the aid of the actual lambda value rear with a manipulated variable which is formed by a second faster means for lambda control with the aid of the actual lambda value front. However, such an arrangement would result in stability problems.

U.S. Pat. No. 4,251,989 discloses a method which helps to prevent the above-mentioned stability problems by using the front probe as a control sensor while at the same time the advantages of the rear probe with respect to lower signal fluctuations are included in the control. The method utilizes the condition that a falsified signal of the probe ahead of the catalytic converter and used for control leads to asymmetry in the output signal of the probe mounted to the rear of the catalytic converter. This dissymmetry is detected via an integrator and is used for changing a comparative threshold which is compared to the output signal of the control probe and which output signal is otherwise influenced. The mixture formation can then be influenced in an ideal manner via units connected downstream so that this change leads to a compensation of the mixture shift caused by the false signal of the first probe.

However, one of the disadvantages of this method is that an oscillating output signal (FIG. 4D, two-step action) of the rear probe is absolutely necessary. In this way, the method is especially not applicable when the control of the lambda value is to a value unequal to zero.

SUMMARY OF THE INVENTION

The invention is based on the object of specifying a method for lambda control which operates in a stable manner and allows a wanted lambda desired value to be set as accurately as possible. The invention is also based on the object of specifying an arrangement for carrying out such a method.

The method according to the invention is characterized by the fact that, with the aid of the actual lambda value rear and an input lambda desired value, to which ultimately control is to be made, a lambda control desired value is formed to which the means for lambda control controls. Thus, the desired-value/actual-value comparison takes place with respect to the reliable actual lambda value rear which enables the lambda value to be accurately set to the actually required input lambda desired value. Because of the fact that the difference between actual lambda value rear and input lambda desired value is not used as system deviation for a means for lambda control but that the usual system deviation between lambda control desired value and actual lambda value front is influenced by an integration value formed with the aid of the difference value, a fast but nevertheless stable control characteristic is obtained.

An arrangement for carrying out such a method has a means for lambda control, a means for forming the difference between an input lambda desired value and the actual lambda value rear, a means for integrating the difference and a means for forming the lambda control desired value with the aid of the integration value. The arrangement is preferably constructed as appropriately programmed microcomputer.

BRIEF DESCRIPTION OF THE DRAWINGS

In the text which follows, the invention will be explained in greater detail with reference to embodiments illustrated by figures, in which.

DESCRIPTION OF THE PREFERRED EMBODIMENTS OF THE INVENTION

Figure 1:
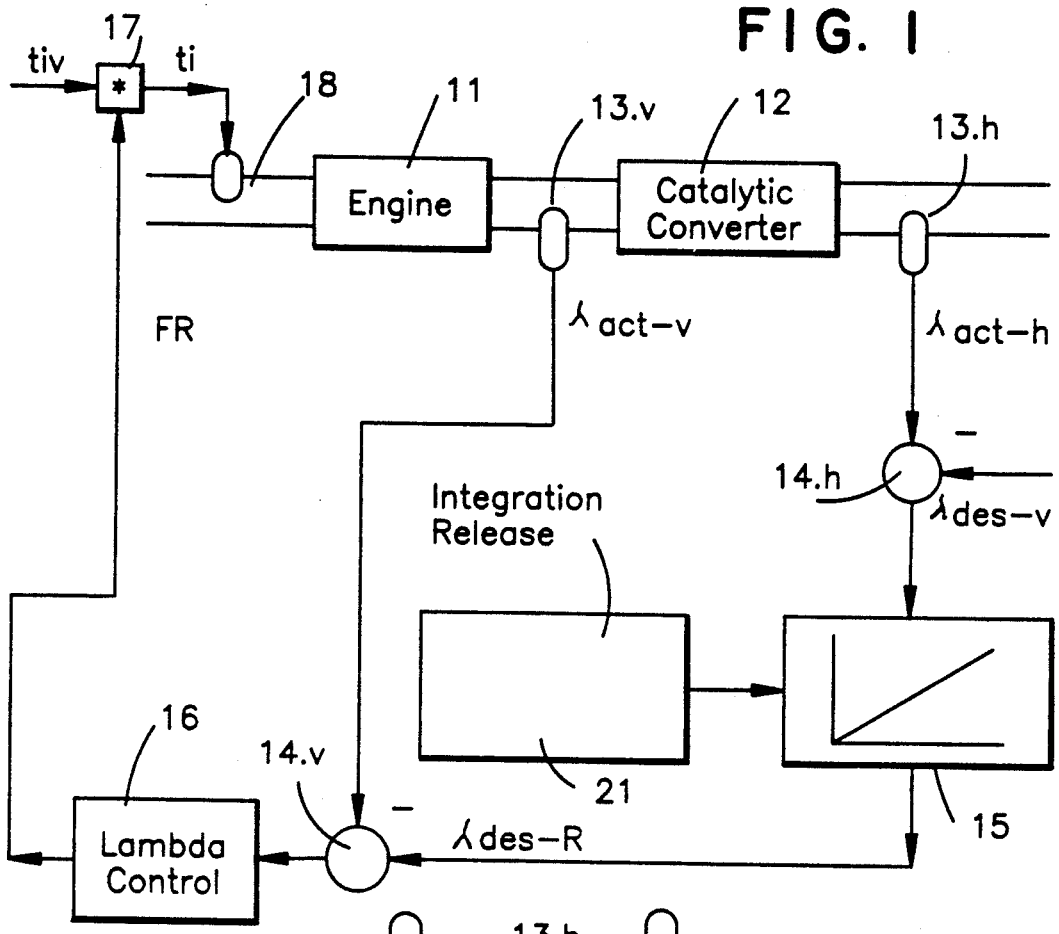
FIG. 1 shows a function block diagram of an arrangement for controlling the lambda value to a single input lambda desired value with the aid of two lambda probes.

The arrangement for lambda control explained in the following with reference to FIG. 1 is arranged at an internal combustion engine 11 with catalytic converter 12, a front lambda probe 13.*v* in front of the catalytic converter and a rear lambda probe 13.*h* behind the catalytic converter. The arrangement has as functional groups a front subtraction means 14.*v*, a rear subtraction means 14.*h*, an integration means 15 and a means for lambda control 16. The manipulated variable of the means for lambda control 16 is supplied to a multiplication means 17 where it is multiplicatively combined with a preliminary injection time tiv for forming an injection time signal ti. The injection time signal is supplied to an injection arrangement 18.

The rear lambda probe 13.*h* measures an actual lambda value rear $\lambda_{act-h}$ which is subtracted in the rear subtraction means 14.*h* from the actually wanted lambda value, the input lambda desired value $\lambda_{des-V}$. The difference is integrated in the integration means 15 and is used as lambda control desired value $\lambda_{des-R}$ for the control in the means 16 for lambda control. From the lambda control desired value, the actual lambda value front $\lambda_{act-v}$, as measured by the front lambda probe 13.*v*, is subtracted in the front subtraction means 14.*v*. The system deviation thus formed is converted by the means 16 for lambda control into the previously mentioned manipulated variable, a control factor FR. This method sequence leads to the following control behavior.

It is assumed that the input lambda desired value is 1 and that at a time at which the observation begins, the injection arrangement 18 happens to provide an air/fuel mixture which leads to the wanted input lambda desired value of 1. However, the internal combustion engine 11 is assumed to operate at an operating point at which a relatively high percentage of hydrocarbons is produced. These hydrocarbons in the exhaust gas lead to the front lambda probe 13.*v* indicating a richer mixture than is actually present. The measured actual lambda value front is, for example, 0.99. The actual lambda value rear, that is the actual lambda value, in contrast, is exactly 1. The integration means 15 is assumed to be set to the value 1. In this case, the difference between input lambda desired value and actual lambda value rear is zero which is why the integration means 15 will not change the integration value set. The lambda control desired value supplied to the front subtraction means 14.*v* is therefore 1, from which the lower actual lambda value front is subtracted. Because of this system deviation, the means 16 for lambda control provides for the mixture to become leaner. The actual lambda value front then rises in the direction of 1 and the actual lambda value rear increases to above 1. As a result, the difference value formed by the rear subtraction means 14.*h* becomes negative as a result of which the integration value, that is the lambda control desired value is lowered by the integration means 15. If it has been lowered down to the value 0.99, the following conditions exist. The injection arrangement 18 again provides for an air/fuel mixture having the lambda value 1. The front lambda probe 13.*v* measures the actual lambda value front 0.99. This corresponds exactly to the lambda control desired value which is why the lambda control 16 leaves the manipulated variable unchanged so that the injection arrangement provides for a mixture having the input lambda value 1 as before. The rear lambda probe 13.*h* measures the lambda value 1. Since this corresponds to the input lambda desired value, the integration value from the integration means 15 remains unchanged at 0.99.

In this manner, the mentioned coupling of signals provides for the means for lambda control 16 to reach exactly the wanted input lambda desired value even though the actual lambda value front used for the control measures the actual lambda value incorrectly. However, controlling for the correct value occurs at a relatively low speed. This is because the speed at which the integration means 15 integrates must not be very high because of the dead time already mentioned above. It is selected, for example, in such a manner that the oscillation of the actual lambda value rear around a mean value is about 1/5 to 1/10 of the control oscillation in the control loop with the means 16 for lambda control.

In FIG. 1, a means 21 for integration release is also drawn which acts on the integration means 15. It is used for blocking the integration process if special conditions exist in which controlling is not for a desired lambda value, for example in overrun mode of operation or in full-load operation.

In practice, controlling is not done continuously to the same lambda value but different lambda values are wanted for different operating conditions. In particular, the mixture is enriched with increasing load in order to counteract in this way an increase of nitrogen oxides in the exhaust gas. Accordingly, it will not be a single input lambda desired value which is used in a practical application of the invention as assumed in FIG. 1 for explaining the basic principle but different input lambda desired values will be inputted for different operating points. Such desired values are suitably stored in a characteristic field which can be evaluated as address values with the aid of values of operating variables. An arrangement with such a characteristic field is shown in FIG. 2.

Figure 2:
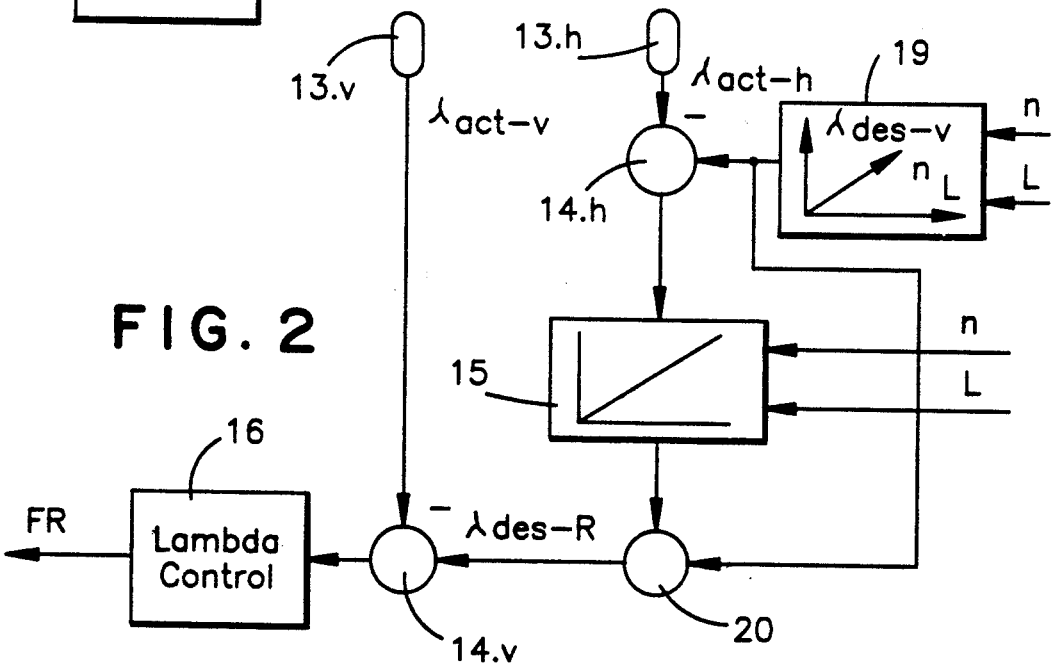
FIG. 2 shows a component function block diagram concerning a relationship of functional groups which is configured in deviation from the corresponding relationship according to FIG. 1 in order to be able to adjust input lambda desired values different from operating point to operating point; and, FIG. 3 shows a component function block diagram according to that of FIG. 2 but with an additional front probe lambda desired value characteristic field.

The arrangement according to FIG. 2 has an input lambda desired value characteristic field 19 which can be addressed via values of the engine speed n and a load-dependent variable L. The particular input lambda desired value $\lambda_{des-V}$ read out is in turn applied to the rear subtraction means 14.*h*. At the same time, it reaches an addition means 20 which is also supplied with the integration value from the integration means 15. The remaining arrangement essentially corresponds to that of FIG. 1. Only the means for integration release 21 is lacking. The reason for this will be explained below.

The purpose of the addition means 20 will be explained with reference to an example. It is initially assumed that this addition means is lacking, that is the configuration according to FIG. 1 exists, but with an input lambda desired value characteristic field which supplies input lambda desired values to the rear subtraction means 14.*h*. Let the output value initially be 1. Then the condition explained with reference to FIG. 1 exists in which the actual lambda value front is 0.99. Now the operating point is assumed to change which is assumed to result in a new input lambda desired value of 0.98. The actual lambda value front measured with this lambda value is assumed to be 0.97. The integration means 15 in the embodiment according to FIG. 1 must then integrate from 0.99 to 0.97 which takes some time. In the embodiment according to FIG. 2, the integration means 15 integrates to −0.001 if the input lambda desired value is 1 and the actual lambda value front is 0.99. If the input lambda desired value jumps from 1 to 0.98, with a corresponding actual lambda value front of 0.97, the new value of 0.98 is supplied directly to the addition means 20. The integration value remains at 0.01. A change in the input lambda desired value thus directly acts on the means for lambda control 16 without the integration means 15 having to become active. It needs to become active only if the difference between actual lambda value rear and actual lambda value front for the new operating point is different from that for the operating point which previously existed.

Even if the last-mentioned aggravating condition exists that different differences between actual lambda value rear and actual lambda value front correspond to different operating points, it can be avoided that the means for integration 15 needs to compensate such a difference by integration with each operating point jump. This can be achieved by structural adaptation. Reference is made to U.S. Pat. No. 4,901,240 with respect to methods for structural adaptation. The possibility of adaptation is indicated in FIG. 2 by the fact that the integration means 15 is supplied with values of operating variables, namely values of the engine speed n and values of a load-dependent variable L. The integration means 15 is configured as a characteristic field. In each characteristic field point, an integration value is stored which was learned in the past. The integration value corresponds to the difference between the actual lambda value rear and the actual lambda value front for the particular operating point. If a change from one operating point to another occurs, the new input lambda desired value from the input lambda desired value characteristic field 19 and the corresponding integration value from the corresponding characteristic field point of the addition means 15 reach the addition means 20. There are no characteristic field points for various values of the addressing variables. For these points, no integration value is emitted which corresponds to the blocking of integration by the means for integration release 21 in the embodiment according to FIG. 1.

Figure 3:
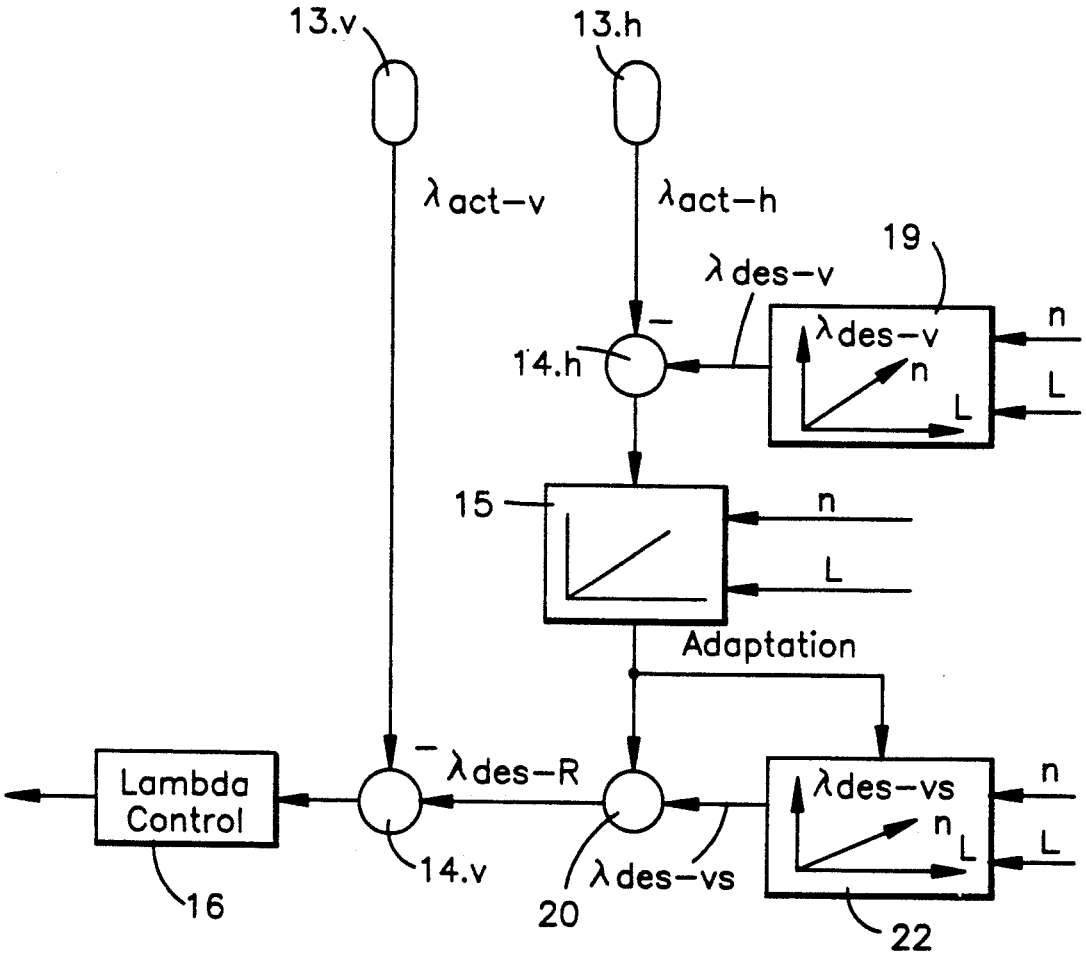

FIG. 3 will now be used for explaining an embodiment which allows a very fast adjustment to a new lambda value after a change of operating point even without structural adaptation. However, adaptation is additionally possible which can then be easily subdivided into a global and a structural part.

The embodiment according to FIG. 3 differs from that according to FIG. 2 in that it is not the input lambda desired value from the input lambda desired value characteristic field 19 which is applied as lambda desired value to the addition means 20 but a front probe lambda desired value from a front probe lambda desired value characteristic field 22. The content of this front probe lambda desired value characteristic field 22 is identical with the content of a conventional lambda desired value characteristic field. Such a characteristic field already takes into account that the lambda probe arranged in front of the catalytic converter measures increasingly incorrectly with increasing content of hydrocarbons in the exhaust gas. If before a particular operating point, for example, the lambda value 0.98 is wanted, it is known however that the front lambda probe measures 0.96 at this lambda value, the value 0.96 is stored in the conventional characteristic field for the relevant operating point and thus also in the front probe lambda desired value characteristic field. In fact, the lambda value 0.98 adjusts with this desired value.

The front probe lambda desired values and the input lambda desired values are recorded for all operating points with the aid of a measuring set-up. The values are stored in the characteristic fields. If an engine used in practice exactly corresponds to the engine with the aid of which the measurement was made and if this also applies to the lambda probes used, the integration means 15 never needs to integrate since exactly the corresponding input lambda desired value is obtained for each operating point with the aid of the front probe lambda desired value read out. If, however, the characteristics of the engine or probes deviate from the characteristics of the parts used when the characteristic fields were recorded, either due to production-related tolerances or due to aging, the integration means 15 compensates for the deviation. The compensating integration value is identical for all operating points for the most important faults, especially for deviations in the probe characteristics. Accordingly, the integration means 15 can be set to a very slow rate of integration. Rapidly changing differences from operating point to operating point in the difference between actual lambda value front and actual lambda value rear are compensated by the different lambda desired values from the two characteristic fields. Long-term changes or tolerance differences are eliminated by the starting value of the integration means 15. If it is to be taken into consideration that changes due to aging or differences due to tolerance can be dependent on operating point, this can be done by adaptively changing the values in the front probe lambda desired value characteristic field 22. In FIG. 3, this is indicated by the output signal from the integrator 15 acting on the characteristic field. Structural adaptation occurs by changing the characteristic field values. A part of the integration value from the integration means 15 can be used for global adaptation. Reference is again made to the above-mentioned U.S. Pat. No. 4,901,240 with respect to applicable adaptation methods.

The previous statements applied to means 16 for lambda control with two-position characteristic and to those with continuous-action characteristic. If the consideration is directed specifically to means for continuous-action lambda control, a further advantage of the method described is obtained. It must be noted that the lambda-value voltage characteristic of a lambda probe is non-linear in all its ranges. However, it can be linearized with quite good accuracy in various ranges, for example in a range of about +/−3% around the lambda value 1. With the aid of the linearized characteristic, a relatively simple control method can be carried out. However, due to the small differences between the actual characteristic and the linearized characteristic, slight deviations occur between the actual lambda value and the measured value. The control is then slightly incorrect. The integration means 15 is also capable of correcting this error as described above with reference to the hydrocarbon error.

The linearization error just described becomes particularly negatively noticeable if the lambda probe is temporarily operated at a temperature which is relatively far from the temperature for which the actual characteristic was determined and on the basis of which the linearization was then performed. This is because the characteristic changes in dependence on temperature. However, the fact is that the rate of change of the probe temperature is less than the rate of integration of the integration means 15. If there is therefore a measuring error of the actual lambda value at the front lambda probe 13.*v* due to the displacement in the characteristic, this error, too, is compensated with the aid of the rear lambda probe 13.*h* and the integration means 15. This is possible because the temperature fluctuates distinctly less behind the catalytic converter 12 than in front of it.

As long as integration is allowed, it is of advantage to integrate at a rate which is proportional to the difference between the actual lambda value rear and the lambda desired value. As a result, the further the actual lambda value rear deviates from the lambda desired value, the faster the integration means 15 changes the lambda control desired value for the means 16 for lambda control. This ensures that the wanted lambda desired value is reached as quickly as possible. However, the rate of integration must not become too high since otherwise a control oscillation could be built up due to the dead time initially mentioned. It is thus recommended to limit the rate of integration in the upward direction. A method which can be carried out more simply is one in which the rate of integration remains permanently the same independently of the value of the difference. This rate of integration is selected to be as high as possible, but only high enough for no control oscillations to occur with inadmissibly high amplitude even in the worst case.

It has been assumed in all embodiments described that the difference value between the actual lambda value rear and the input lambda desired value corresponds to the difference value between these two quantities. However, it is also sufficient to only determine whether one value is greater than the other or not and to integrate in one or the other direction, depending on the result of the comparison.

We claim:

1. A method of lambda control for an internal combustion engine to which an air/fuel mixture having a lambda value is supplied, the engine having a catalytic converter and the method comprising the steps of:

providing a first lambda probe arranged forward of the catalytic converter and measuring a lambda value front with said first lambda probe;

controlling said lambda value of the air/fuel mixture to a control lambda desired value with the aid of said lambda value front;

providing a front probe lambda desired value characteristic field for providing a front probe lambda desired value;

providing a second lambda probe arranged rearward of said catalytic converter and measuring the actual lambda value rear with said second lambda probe;

forming a difference value between said actual lambda value rear and an input lambda desired value which is to be reached;

forming an integration value from said difference value with said control lambda desired value being dependent upon said integration value; and, using the integration values for adapting said front probe lambda desired value characteristic field.

2. An arrangement for lambda control for an internal combustion engine to which an air/fuel mixture having a lambda value is supplied, the engine having a catalytic converter and the arrangement comprising:

a first lambda probe arranged forward of the catalytic converter for measuring a lambda value front;

lambda control means for lambda controlling said lambda value of the air/fuel mixture to a control lambda desired value;

said lambda control means being connected to said first lambda probe for receiving said lambda value front;

means for providing an input lambda desired value corresponding to the actual desired air/fuel ratio;

a second lambda probe arranged rearward of the catalytic converter for measuring a lambda actual value rear;

means for forming a difference value between said input lambda desired value corresponding to the actual wanted air/fuel ratio and said lambda actual value rear;

means for integrating said difference value to form an integration value;

means for forming said control lambda desired value in dependence upon said integration value;

front probe lambda desired value characteristic field means for providing a front probe lambda desired value; and, means for adapting said front probe lambda desired value characteristic field.

3. The arrangement of claim 2, further comprising: addition means for forming said control lambda desired value from the particular integration value and the particular front probe lambda desired value.

* * * * *